United States Patent [19]

Solt

[11] 3,968,768

[45] July 13, 1976

[54] REMOTELY CONTROLLED STEERING TRANSOM FOR OUTBOARD MOTORS

[76] Inventor: Dean L. Solt, 3271 S. 1800 West, Granger, Utah 84119

[22] Filed: Sept. 29, 1975

[21] Appl. No.: 617,278

[52] U.S. Cl. ..... 115/18 R; 248/4

[51] Int. Cl.[2] ..... B63H 21/26

[58] Field of Search ..... 115/17, 18, 35; 114/153, 160, 144 R; 248/4

[56] References Cited

UNITED STATES PATENTS

| | | | |
|---|---|---|---|
| 2,928,631 | 3/1960 | Hartman | 248/4 |
| 2,939,658 | 6/1960 | Roemer | 248/4 |
| 2,951,460 | 9/1960 | Pierson | 115/18 R X |
| 3,075,490 | 1/1963 | Lang | 248/4 X |
| 3,283,738 | 11/1966 | Nelsen | 115/18 R |

*Primary Examiner*—Trygve M. Blix
*Assistant Examiner*—Sherman D. Basinger
*Attorney, Agent, or Firm*—Criddle, Thrope & Western

[57] ABSTRACT

A remotely controlled steering transom for outboard motors which comprises a frame having a transom plate adapted to be attached to the transom of a boat. Top and bottom plates extend backwardly and inwardly from the transom plate terminating in a tubular bearing support. A spindle is journaled through the bearing support and is received into caps at either end. The caps are connected to the central portion of a rear metal plate which will turn with the spindle as the spindle is rotated within the bearing support. A reversible electric motor driving pulley is mounted on a bracket affixed to the transom plate. Tension springs are mounted to the transom on either side of the motor and in the same plane as the pulley. A pulley is fixedly attached to either side of the rear metal plate, facing the tension springs. A flexible cable attached to one tension spring extends around the pulley opposite that spring from the outside to the inside, is wrapped in looped relationship around the pulley driven by the motor, passes around the second pulley from inside to outside and is attached to the second tension spring. Wooden members are affixed to either side of the rear metal plate and are adapted to receive an outboard motor. The electric motor is powered by a battery and is actuated by a switch via an electric cord from the boat. Actuation of the motor causes the motor driven pulley to rotate in the desired direction frictionally passing cable about said pulley in the direction of rotation thereby causing the rear metal plate to pivot or rotate in the direction opposite the rotation of the motor driven pulley. The boat is thus turned or steered by the pivoting of the rear metal plate rather than the rotation of the outboard motor in relation to its mounting.

8 Claims, 6 Drawing Figures

REMOTELY CONTROLLED STEERING TRANSOM FOR OUTBOARD MOTORS

BACKGROUND OF THE INVENTION

This invention relates to a steering system for outboard motors. More particularly, this invention relates to a remotely operated system for steering outboard motors wherein a horizontally rotatable auxiliary transom is used.

There are many instances where it is desirable to control the movement of a boat containing an outboard motor without having to remain in the rear seat of the boat with a hand on the tiller, or in the alternative, sitting in a fixed position at the steering wheel. For example, it would be desirable to steer a boat from any position when trolling or maneuvering around objects which are difficult to see from the sterm or other steering position in the boat, or when navigating in waters wherein only minimal steerage guidance is required.

Various methods have been proposed for remotely altering the course of a boat containing an outboard motor. In most cases these involve the usage of an electric motor which is in some way attached to or controls the movement of the outboard motor about its point of attachment to the stern or transom of the boat. Typical patents showing such remote control mechanisms are U.S. Pat. Nos. 2,583,059; 2,804,838; 2,877,733; 2,951,460; and 3,283,738.

Pleasure boats today may consist of either inboard or outboard motors and the trend is towards larger and more powerful motors permitting both rapidity of movement and the pulling of one or more water skiers. These larger motors, however, are not practical for trolling when fishing or for other similar slow moving purposes. Boats having such motors often have need for an auxiliary transom carrying a smaller motor which can be used for trolling or other slower cruising purposes.

It is an object of this invention to provide a remote control steering mechanism comprising a rotatable auxiliary steering transom.

It is also an object of this invention to provide a remote control steering system wherein the auxiliary transom rotates but the motor itself does not turn in relation to the motor mounting.

It is a further object of this invention to provide a remote control steering mechanism utilizing a rotatable auxiliary transom wherein the transom is turned by means of an electrically driven cable and pulley drive system.

It is also an object of this invention to provide a remote control steering mechanism using a rotatable auxiliary transom wherein the steering can be controlled from any position in the boat.

These and other objects may be accomplished by means of a novel auxiliary transom consisting of a frame which can be fixedly attached to the transom of a boat by means of a transom plate. There is attached to the transom plate, top and bottom plates which extend backwardly and inwardly terminating in a tubular bearing support. A spindle is journaled through the bearing support and is fitted into caps at the top and bottom of the spindle. The caps are welded or otherwise affixed to a rear metal plate such that the rear plate will turn with the spindle as the spindle is rotated in the bearing support. Wood members are affixed to the rear plate to provide means against which an outboard motor may be mounted. A bracket is affixed to the transom plate and supports a reversible electric motor which drives a pulley. On either side of the motor bracket, and in the same plane as the motor driven pulley are tension springs. Opposite the tension springs and carried by brackets attached to the rear metal plate are pulleys. A flexible cable has one end connected to one of the tension springs, is passed from an outside to inside relationship around the opposite pulley, and then passes in looped relationship around the motor driven pulley, and further passes from inside to outside relationship around the remaining pulley and has its end attached to the other tension spring.

In operation, the transom plate is attached to the transom of a boat and the motor is affixed into position on the rear metal plate containing the wooden mounting members. A battery is connected to the electric motor and a double acting switch on the end of a long cable is placed in the boat such that it can be operated to drive the motor in either desired direction from any position in the boat. As the electric motor is operated in response to actuation of the switch in one direction or the other, the cable is frictionally moved about the motor driven pulley with the slack being taken up by the tension springs, and the rear mounting plate is rotated in a direction opposite the direction of rotation of the motor driven pulley. The outboard motor does not rotate relative to its mounted position on the rear metal plate but rotates with the rear metal plate as that plate rotates around the spindle thereby steering the boat.

The novel features of this invention, both as to the manner of construction as well as the operation, will be better understood with reference to the following description and drawings. It is to be understood, however, that the description and drawings are for the purpose of illustration only and are not intended to be a definition as to the scope of the invention.

DRAWINGS OF THE INVENTION

DETAILED DESCRIPTION OF THE INVENTION

Figure 1:
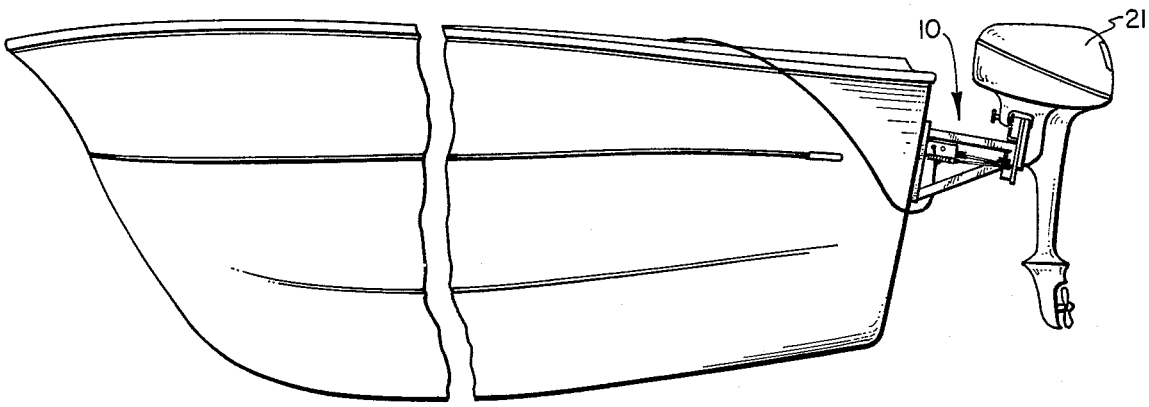
FIG. 1 is a side elevation view of a boat equipped with a rotatable auxiliary transom to which is mounted an outboard motor.
Figure 2:
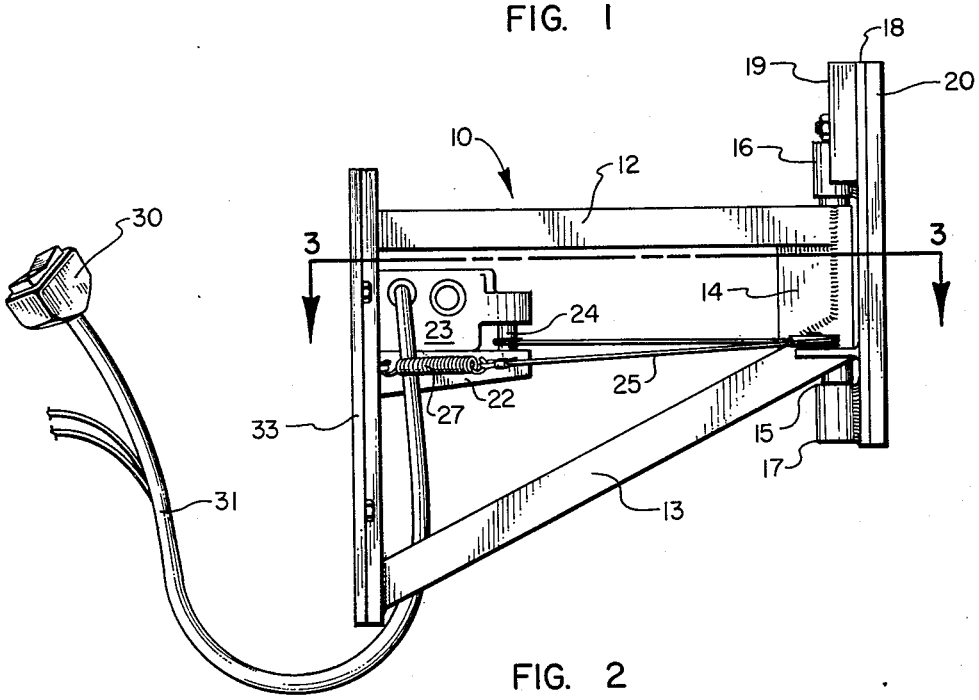
FIG. 2 is a side elevational view of the rotatable auxiliary transom.
Figure 3:
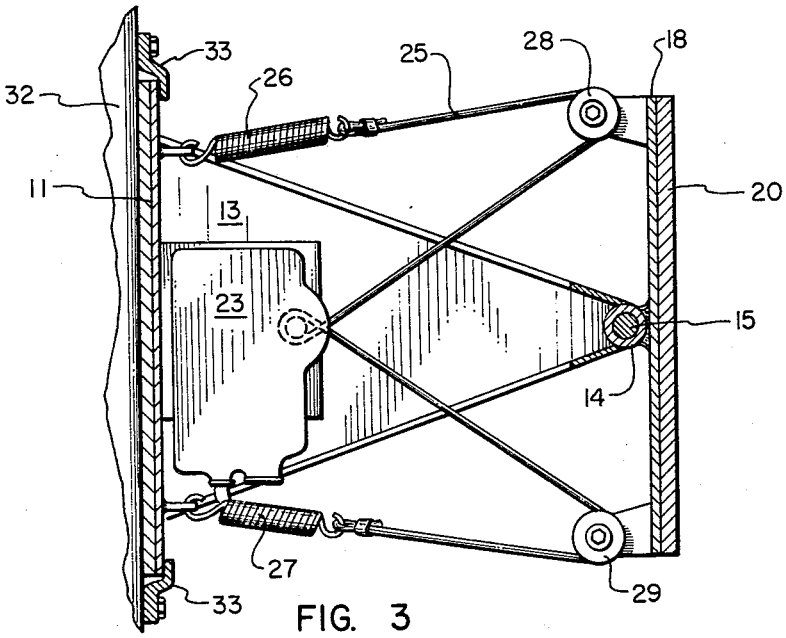
FIG. 3 is a horizontal sectional view taken along lines 3—3 of FIG. 2.

Referring now to the drawings:

There is shown in FIGS. 1, 2 and 3 a preferred embodiment of the present invention. The rotatable auxiliary transom 10 is made up of a framework consisting of a metal transom plate 11 to which is attached a top plate 12 and a bottom plate 13. As illustrated in FIGS. 2 and 3, the top plate 12 and bottom plate 13 angle backwardly and inwardly from transom plate 11 and terminate at tubular bearing support 14. As shown in FIG. 2, bottom plate 13 angles upwardly in addition.

Both upper plate 12 and lower plate 13 are essentially triangular in shape. If desired for added structural support, both plates 12 and 13 may be bent at a 90° angle along the outer edges thereof to form a lip or flange which will provide added structural strength when attached to transom plate 11 and to bearing support 14. Spindle 15 is journaled through the bearing support 14. The spindle is of sufficient length so that the ends thereof, when passed through bearing support 14 are exposed and are adapted to fit into spindle caps 16 and 17 at either end of the spindle. The spindle caps 16 and 17 are welded or otherwise attached to the vertical center of rear metal plate 18. Also affixed to the rear metal plate 18 are wood members 19 and 20 which provide means whereby an outboard motor shown as 21 in FIG. 1 can be attached. Mounting board 19 extends horizontally across the top of plate 18 on the inside portion thereof and may have to be partially cut away to make room for spindle cap 16. Wood member 20 is mounted to the other side of metal plate 18 so as to substantially cover the entire surface against which an outboard motor mount would rest.

Affixed to transom plate 11, between top plate 12 and bottom plate 13 is a mounting bracket 22 which supports a reversible electric motor 23. Interconnected with and driven by motor 23 is a pulley 24, the rotation of which provides the driving means to rotate rear plate 18. Means for interconnecting motor driven pulley 24 and rear plate 18 are now described. Affixed to either side of the transom plate 18 and in the same horizontal plane as pulley 24 are tension springs 26 and 27. On either side of the bearing support 14 and affixed to rear plate 18 by appropriate bracketing means are pulleys 28 and 29. The pulleys 24, 28 and 29 and tension springs 26 and 27 are all interconnected by means of cable 25. One end of the cable is attached to tension spring 26 which then passes around pulley 28 from outside to inside and is then looped around motor driven pulley 24 and then further passes around pulley 29 from the inside to the outside and terminates by being attached to the end of tension cable 27.

A double acting switch 30 is attached to electric motor 23 by means of electric cable 31 which is also connected to a battery.

In operation the rotatable auxiliary transom is mounted to the transom 32 of a boat as illustrated in FIG. 3 by means of mounting brackets 33. The motor 21 is affixed into position on mounting supports 19 and 20 attached to rear metal plate 18. A battery is connected to the electric motor 23 and the double acting switch 30, on the end of a long cable 31, is positioned in the boat. As the electric motor 23 is operated in response to actuation of switch 30 in one direction or the other, the cable 25 is frictionally moved around the motor driven pulley 24 with the slack being taken up by springs 26 and 27. As the cable is rotated around pulley 24, rear plate 18 and the motor 21 carried thereby are rotated about spindle 15 thereby steering the boat in the desired direction.

Various modifications may be employed without departing from the scope of the invention. Some such variations are illustrated in FIGS. 4, 5 and 6.

Figure 4:
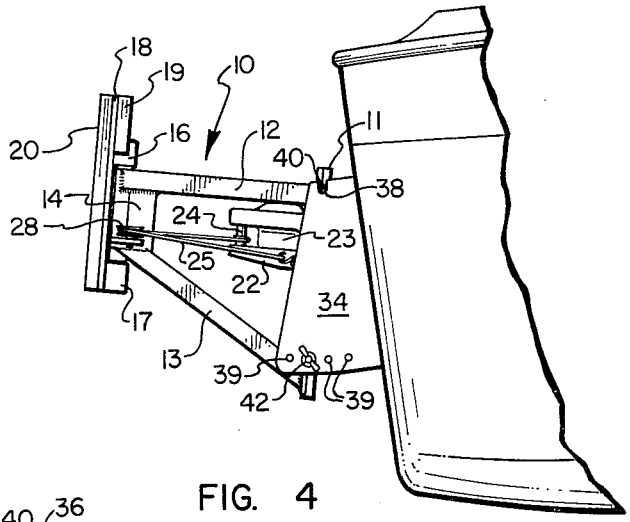
FIG. 4 is a side elevation view of the rear portion of a boat containing another version of the rotatable auxiliary transom wherein the frame is adjustable.
Figure 5:
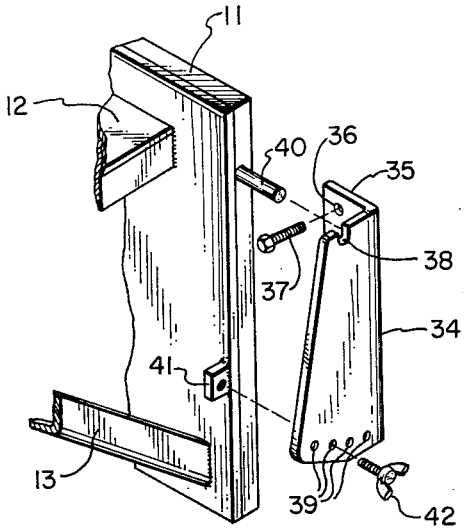
FIG. 5 is a sectional view of the framework shown in FIG. 4 showing the adjustment means.

FIGS. 4 and 5 show an auxiliary transom mounted to an adjustable bracket 34 whereby the angle of the outboard motor can be rotated within a limited degree around an axis at the top of the mounting bracket as will be described. As illustrated in FIG. 5, bracket 34 is bent at right angles to provide a mounting surface 35 containing holes 36 through which a bolt 37 may pass to secure the mounting bracket to the transom of a boat. At the top of bracket 34 is an indentation 38 and at the bottom of bracket 34 is an arcuate pattern of holes 39. Attached to transom plate 11 is a metal rod 40 adapted to be received into slot 38. Also attached to transom plate 11 at the lower portion thereof and in alignment with holes 39, is a threaded support block 41. The auxiliary transom may be mounted to bracket 34 by inserting rods 40 into slots 38 which serves as the axis of rotation. The auxiliary transom may then be secured in any desired position by inserting bolt 42 through any of holes 39 and threading the bolt 42 into support block 41 thereby securing the auxiliary transom to the adjustable mounting bracket 34.

Figure 6:
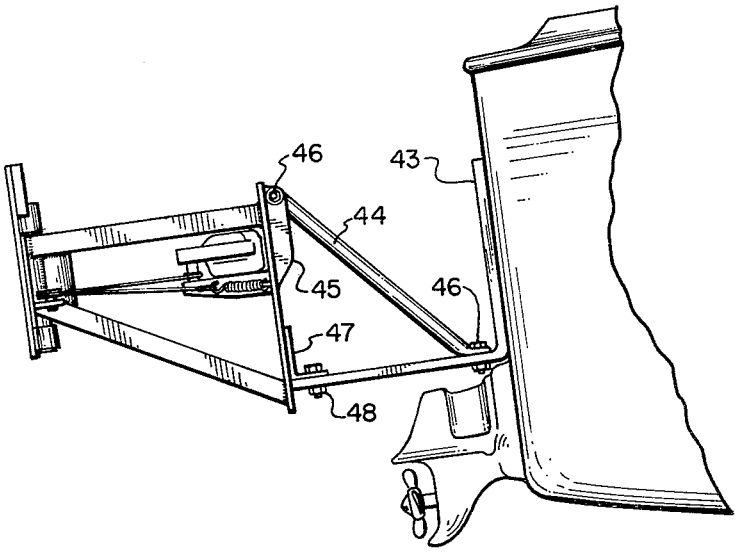
FIG. 6 is a side elevational view of the rear portion of a boat having mounted thereto another version of a rotatable auxiliary transom separated from the transom of the boat by a mounting platform.

An additional modification is illustrated in FIG. 6 which is especially adaptable for mounting to the transom of a boat containing an inboard motor. This adaptation consists of a platform 43 which may be used for swimming, fishing or any other purpose. Platform 43 is secured to the boat transom and is strengthened by support arms 44, the upper end of which is affixed to a flange 45 protruding at right angles from transom plate 11. Both ends of support arm 44 are fastened by bolt means 46. The transom plate 11 is additionally secured to the platform 43 by means of an angle iron support 47 which may be either welded to the transom plate or attached by bolt means 48.

Although the invention as has been described is deemed to be that which would form the preferred embodiments it is recognized that departures may be made therefrom without departing from the scope of the invention which is not to be limited to the details disclosed, but is to be accorded the full scope of the claims so as to include any and all equivalent devices.

What is claimed is:

1. A remotely controlled steering transom for outboard motors comprising a. a frame adapted to be attached to the transom of a boat by mounting means, said frame having a front plate, top and bottom plates affixed to said front plate each of which extend rearwardly being affixed at the rear most portions thereof to a tubular bearing support, b. a spindle journaled through said bearing support having projecting ends, c. caps inserted over the projecting ends of said spindle, said caps being affixed to the vertical center portion of a rear metal plate, d. means affixed to said rear metal plate on which to mount an outboard motor, e. bracket means affixed to the front plate of said frame between the top and bottom plates, f. a reversible electric motor connectible to a battery attached to said bracket means and interconnected with a motor driven pulley, g. a double acting switch attached to said reversible electric motor by means of an electric cable of sufficient length to be positioned at any desired location in the boat to be steered, h. tension springs affixed to the front plate on either side of the reversible electric motor, i. pulley means mounted on either side of the rear metal plate facing said tension springs, and j. a flexible cable affixed at each end to the tension springs, said cable passing around said oppositely facing pulleys from an outside to the inside relationship, the portion of said cable between said pulleys being looped around said motor driven pulley such that when said electric motor is operated in response to the double acting switch, the flexible cable will be frictionally moved around the motor driven pulley thereby causing the rear plate containing the outboard motor to rotate about the spindle in a direction opposite to the direction of rotation of the motor driven pulley thereby steering the boat.

2. A remotely controlled steering transom for outboard motors as claimed in claim 1 wherein the motor driven pulley, tension springs, and oppositely facing pulleys are in the same horizontal plane.

3. A remotely controlled steering transom for outboard motors as claimed in claim 2 wherein the bottom plate affixed to the front plate extends both rearwardly and upwardly.

4. A remotely controlled steering transom for outboard motors as claimed in claim 3 wherein both top and bottom plates extend rearwardly and inwardly being substantively triangular in shape.

5. A remotely controlled steering transom for outboard motors as claimed in claim 4 wherein the means affixed to the rear metal plate on which to mount an outboard motor consists of wooden members attached to both sides of said metal plate.

6. A remotely controlled steering transom for outboard motors as claimed in claim 5 wherein the mounting means consist of a pair of brackets mounted to the transom of the boat adapted to receive said front plate of the frame.

7. A remotely controlled steering transom for outboard motors according to claim 5 wherein the mounting means consist of a set of adjustable brackets being formed at right angles, one side of said bracket being adapted to be attached to the transom of a boat, the other side of said bracket extending perpendicularly therefrom having a slot in the upper portion thereof and a series of arcuate holes at the bottom portion thereof, said steering transom containing a horizontally extending rod adapted to be received into the slot of the mounting brackets and containing in the lower portion thereof a threaded support block in alignment with the arcuate holes adapted to receive a threaded bolt which, when passed through any of the arcuate holes, can be threaded into said support block thereby securing the steering transom in the desired position.

8. A remotely controlled steering transom for outboard motors as claimed in claim 5 wherein the mounting means consist of a platform attached to the transom of the boat extending backwardly and containing means to which the front plate of the steering transom frame is attached.

* * * * *